US006141637A

United States Patent [19]

Kondo

[11] Patent Number: 6,141,637

[45] Date of Patent: Oct. 31, 2000

[54] SPEECH SIGNAL ENCODING AND DECODING SYSTEM, SPEECH ENCODING APPARATUS, SPEECH DECODING APPARATUS, SPEECH ENCODING AND DECODING METHOD, AND STORAGE MEDIUM STORING A PROGRAM FOR CARRYING OUT THE METHOD

[75] Inventor: Kazunobu Kondo, Hamamatsu, Japan

[73] Assignee: Yamaha Corporation, Hamamatsu, Japan

[21] Appl. No.: 09/167,072

[22] Filed: Oct. 6, 1998

[30] Foreign Application Priority Data

Oct. 7, 1997 [JP] Japan ..... 9-273186
Oct. 14, 1997 [JP] Japan ..... 9-280836

[51] Int. Cl.[7] ..... G10L 21/00

[52] U.S. Cl. ..... 704/204; 704/203; 704/205; 704/222; 704/219

[58] Field of Search ..... 704/201, 203, 704/204, 205, 219, 220, 222

[56] References Cited

U.S. PATENT DOCUMENTS 5,396,576 3/1995 Miki et al. ..... 704/222
5,684,920 11/1997 Iwakami et al. ..... 704/203
5,819,212 10/1998 Matsumoto et al. ..... 704/219
5,909,663 6/1999 Ijjima et al. ..... 704/226

*Primary Examiner*—David R. Hudspeth
*Assistant Examiner*—Abul K. Azad
*Attorney, Agent, or Firm*—Pillsbury Madison & Sutro LLP

[57] ABSTRACT

A speech encoding and decoding system comprises a speech coding apparatus and a speech decoding apparatus. The speech encoding apparatus orthogonally transforms an input speech signal represented in a time domain into a signal represented in a frequency domain in units of predetermined blocks, smoothes the resulting orthogonal transform coefficients by auxiliary information obtained by analyzing the speech signal, vector-quantizes the smoothed orthogonal transform coefficients to generate a quantization index, extracts a vector quantization error of low frequency components of the vector-quantized smoothed orthogonal transform coefficients, scalar-quantizes the vector quantization error to determine low frequency range correction information, and outputs the auxiliary information, quantization index, and low frequency range correction information. The speech decoding apparatus vector inversely quantizes the quantization index to decode the orthogonal transform coefficients, decodes the auxiliary information and low frequency range correction information, corrects the low frequency components of the decoded orthogonal transform coefficients by the low frequency range correction information, and restores the corrected orthogonal transform coefficients into a state before being smoothed by the auxiliary information, and orthogonally inversely transforms the restored orthogonal transform coefficients to decode the speech signal represented in the time domain.

7 Claims, 7 Drawing Sheets

SPEECH SIGNAL ENCODING AND DECODING SYSTEM, SPEECH ENCODING APPARATUS, SPEECH DECODING APPARATUS, SPEECH ENCODING AND DECODING METHOD, AND STORAGE MEDIUM STORING A PROGRAM FOR CARRYING OUT THE METHOD

BACKGROUND OF THE INVENTION

1. Field of the Invention

The present invention relates to encoding and decoding of a signal indicative of speech or musical tones (hereinafter generically referred to as "speech signal"), which comprises compression encoding the speech signal by orthogonally transforming the speech signal represented in the time domain into a signal represented in the frequency domain and conducting vector quantization of the resulting orthogonal transform coefficients, and decoding the compressed encoded speech signal.

2. Prior Art

Conventionally, vector quantization is widely known as a method of compression encoding a speech signal which is capable of achieving high-quality compression encoding at a low bit rate. The vector quantization quantizes the waveform of a speech signal in units of given blocks into which the speech signal is divided. and therefore has the advantage that its required amount of information can be largely reduced. Thus, the vector quantization is widely used in the field of communication of speech information, and the like. A code book used in the vector quantization has vector codes thereof updated by learning according to generalized Lloyd's algorithm or the like using a lot of learned sample data. The thus updated code book, however, has its contents largely affected by characteristics of the learned sample data. To prevent the contents of the code book from having characteristics closer to particular characteristics, the learning must be carried out using a considerably large number of sample data. It is, however, impossible to provide such a large number of sample data for all of the possible patterns that are to be stored in the code book. Therefore, in actuality, the code book is prepared using data which are as random as possible.

On the other hand, in compression encoding a speech signal, it is employed to previously subject the speech signal to orthogonal transform (e.g. FFT, DCT, or MDCT) to achieve a higher compression efficiency in view of partiality of the power spectrum of the speech signal. When the orthogonal transform is conducted on a speech signal to be subjected to the vector quantization, it is desirable that orthogonal transform coefficients obtained by the orthogonal transform have amplitude thereof set to a fixed level before being subjected to vector quantization, because if the orthogonal transform coefficients have uneven values of amplitude, many code bits are required, and accordingly the number of code vectors corresponding thereto becomes very large. To this end, when the orthogonal transform coefficients are vector-quantized, the frequency spectrum (orthogonal transform coefficients) of the speech signal is smoothed by using one or more of the following methods (i) to (iv), into data suitable for vector quantization, and then learning of the code book is carried out using the data (e.g. Iwagami et al., "Audio Coding by Frequency Region-Weighted Interleaved Vector Quantization (TwinVQ)", The Acoustical Society of Japan, Lecture Collection, October, pp/339, 1994):

(i) the speech signal is subjected to linear predictive coding (LPC) to predict its spectral envelope, (ii) a moving average prediction method or the like is used to remove correlation between frames, (iii) pitch prediction is carried out, and (iv) redundancy dependent upon the frequency band is removed using psycho-physical characteristics of the listener's aural sense.

Information for smoothing the orthogonal transform coefficients according to one or more of the above methods is transmitted as auxiliary information together with a quantization index.

Most speech signals have stationary harmonic structures, and consequently the envelope of a train of transform coefficients obtained by orthogonally transforming a speech signal into a signal in the frequency domain has fine spiky irregularities. These irregularities cannot be fully expressed even by the use of LPC and the pitch prediction in combination. Therefore, the above-mentioned prior art smoothing techniques do not yet provide satisfactory results of smoothing of the frequency spectrum of a speech signal.

According to the vector quantization which requires that the orthogonal transform coefficients should have almost fixed amplitude, a conspicuous vector quantization error appears at portions which have not been smoothed. In the case of a speech signal having a relatively strong pitch or fundamental tone in particular, a vector quantization error occurs at a low frequency region, causing a degradation in the sound quality which is aurally perceivable. If an increased number of code bits are used to enhance the reproducibility of low frequency components, however, the number of code vectors corresponding thereto becomes very large, as stated above, causing an increase in the bit rate.

SUMMARY OF THE INVENTION

It is an object of the invention to provide a speech encoding and decoding system, a speech encoding apparatus, a speech decoding apparatus, a speech encoding and decoding method, and a storage medium storing a program for carrying the method, which are capable of encoding and/or decoding a speech signal at a bit rate at substantially the same level as that of the prior art vector quantization and with reduced degradation in the quality of the reproduced sound.

To attain the above object, the present invention provides a speech encoding and decoding system comprising a speech coding apparatus including an orthogonal transform device that orthogonally transforms an input speech signal represented in a time domain into a signal represented in a frequency domain in units of predetermined blocks into which the speech signal is divided to determine orthogonal transform coefficients, a speech signal analyzing device that analyzes the speech signal to determine auxiliary information for smoothing the orthogonal transform coefficients, a first calculating device that smoothes the orthogonal transform coefficients by means of the auxiliary information determined by the speech signal analyzing device, a vector quantization device that vector-quantizes the orthogonal transform coefficients smoothed by the first calculating device to generate a quantization index indicative of the smoothed orthogonal transform coefficients vector-quantized by the vector quantization device, a low frequency component error-extracting device that extracts a vector quantization error of low frequency components of the smoothed orthogonal transform coefficients vector-quantized by the vector quantization device, a low frequency range correction information-determining device that scalar-quantizes the vector quantization error extracted by the low frequency component error-extracting device to determine low frequency range correction information, and a synthesis device that synthesizes the auxiliary information from the speech signal analyzing device, the quantization index indicative of the smoothed orthogonal transform coefficients vector-quantized by the vector quantization device from the vector quantization device, and the low frequency range correction information from the low frequency range correction information-determining device to output them as an encoded output, and a speech decoding apparatus including a vector inverse quantization device that vector inversely quantizes the quantization index included in the encoded output from the speech encoding apparatus to decode the orthogonal transform coefficients, an auxiliary information decoding device that decodes the auxiliary information included in the encoded output from the speech encoding apparatus, a low frequency range correction information-decoding device that decodes the low frequency range correction information included in the encoded output from the speech encoding apparatus, a second calculating device that corrects the low frequency components of the orthogonal transform coefficients decoded by the vector inverse quantization device by means of the low frequency range correction information decoded by the low frequency range correction information-decoding device, and restores the corrected orthogonal transform coefficients into a state before being smoothed by means of the auxiliary information decoded by the auxiliary information decoding device, and an orthogonal inverse transform device that orthogonally inversely transforms the orthogonal transform coefficients restored into the state before being smoothed by the second calculating device into a signal represented in the time domain to thereby decode the speech signal represented in the time domain.

Preferably, the speech encoding apparatus includes a second vector inverse quantization device that vector inversely quantizes the quantization index from the vector quantization device to generate decoded orthogonal transform coefficients, the low frequency component error-extracting device extracting an error between the low frequency components of the smoothed orthogonal transform coefficients from the first calculating device and low frequency components of the decoded orthogonal transform coefficients from the second vector inverse quantization device.

To attain the object, the present invention further provides a speech encoding apparatus comprising an orthogonal transform device that orthogonally transforms an input speech signal represented in a time domain into a signal represented in a frequency domain in units of predetermined blocks into which the speech signal is divided to determine orthogonal transform coefficients, a speech signal analyzing device that analyzes the speech signal to determine auxiliary information for smoothing the orthogonal transform coefficients, a calculating device that smoothes the orthogonal transform coefficients by means of the auxiliary information determined by the speech signal analyzing device, a vector quantization device that vector-quantizes the orthogonal transform coefficients smoothed by the calculating device to generate a quantization index indicative of the smoothed orthogonal transform coefficients vector-quantized by the vector quantization device, a low frequency component error-extracting device that extracts a vector quantization error of low frequency components of the smoothed orthogonal transform coefficients vector-quantized by the vector quantization device, a low frequency range correction information-determining device that scalar-quantizes the vector quantization error extracted by the low frequency component error-extracting device to determine low frequency range correction information, and a synthesis device that synthesizes the auxiliary information from the speech signal analyzing device, the quantization index from the vector quantization device, and the low frequency range correction information from the low frequency range correction information-determining device to output them as an encoded output.

To attain the object, the present invention also provides a speech decoding apparatus comprising an information separating device that receives and separates auxiliary information for smoothing orthogonal transform coefficients obtained by orthogonally transforming an input speech signal represented in a time domain into a signal represented in a frequency domain in units of a predetermined block, a quantization index obtained by vector-quantizing the orthogonal transform coefficients smoothed by means of the auxiliary information, and low frequency range correction information obtained by scalar-quantizing a vector quantization error of low frequency components of the smoothed orthogonal transform coefficients, a vector inverse quantization device that vector inversely quantizes the quantization index separated by the information separating device to decode the orthogonal transform coefficients, an auxiliary information decoding device that decodes the auxiliary information separated by the information separating device, a low frequency range correction information-decoding device that decodes by inverse scalar quantization the low frequency range correction information separated by the information separating device, a calculating device that corrects the low frequency components of the orthogonal transform coefficients decoded by the vector inverse quantization device by means of the low frequency range correction information decoded by the low frequency range correction information-decoding device, and restores the corrected orthogonal transform coefficients into a state before being smoothed by means of the auxiliary information decoded by the auxiliary information decoding device, and an orthogonal inverse transform device that orthogonally inversely transforms the orthogonal transform coefficients restored into the state before being smoothed by the calculating device into a signal represented in the time domain to thereby decode the speech signal represented in the time domain.

To attain the object, the present invention provides a speech encoding and decoding method comprising a speech coding process including an orthogonal transform step of orthogonally transforming an input speech signal represented in a time domain into a signal represented in a frequency domain in units of predetermined blocks into which the speech signal is divided to determine orthogonal transform coefficients, a speech signal analyzing step of analyzing the speech signal to determine auxiliary information for smoothing the orthogonal transform coefficients, a first calculating step of smoothing the orthogonal transform coefficients by means of the auxiliary information determined by the speech signal analyzing step, a vector quantization step of vector-quantizing the orthogonal transform coefficients smoothed by the first calculating step to generate a quantization index indicative of the smoothed orthogonal transform coefficients vector-quantized by the vector quantization step, a low frequency component error-extracting step of extracting a vector quantization error of low frequency components of the smoothed orthogonal transform coefficients vector-quantized by the vector quantization step, a low frequency range correction information-determining step of scalar-quantizing the vector quantization error extracted by the low frequency component error-extracting step to determine low frequency range correction information, and a synthesis step of synthesizing the auxiliary information obtained by the speech signal analyzing step, the quantization index obtained by the vector quantization step, and the low frequency range correction information obtained by the low frequency range correction information-determining step to output them as an encoded output, and a speech decoding process including a vector inverse quantization step of inversely vector-quantizing the quantization index included in the encoded output provided by the speech encoding process to decode the orthogonal transform coefficients, an auxiliary information decoding step of decoding the auxiliary information included in the encoded output, a low frequency range correction information-decoding step of decoding the low frequency range correction information included in the encoded output, a second calculating step of correcting the low frequency components of the orthogonal transform coefficients decoded by the vector inverse quantization step by means of the low frequency range correction information decoded by the low frequency range correction information-decoding step, and restores the corrected orthogonal transform coefficients into a state before being smoothed by means of the auxiliary information decoded by the auxiliary information decoding step, and an orthogonal inverse transform step of orthogonally inversely transforming the orthogonal transform coefficients restored into the state before being smoothed by the second calculating step into a signal represented in the time domain to thereby decode the speech signal represented in the time domain.

Further, to attain the object, the present invention provides a storage medium storing a program for carrying out the above speech encoding and decoding method.

According to the present invention constructed as above, the orthogonal transform coefficients are smoothed by means of the auxiliary information obtained by analyzing a speech signal, the vector quantization error of low frequency components of the smoothed orthogonal transform coefficients is extracted and scalar-quantized to obtain the low frequency range correction information, and the quantization index obtained by vector-quantizing the smoothed orthogonal transform coefficients as well as the low frequency range correction information and the auxiliary information are output as an encoded output. As a result, the low frequency components of the orthogonal transform coefficients can be accurately reproduced by correcting the low frequency components by the low frequency range correction information, without appreciable degradation of the sound quality which is aurally perceivable. Thus, a high quality of decoded sound can be obtained with addition of a small amount of information. That is, the low frequency range correction information corresponds to an error component based on the vector quantization error of the orthogonal transform coefficients, i.e. a difference in amplitude between the orthogonal transform coefficients before vector quantization and after the same, and further the vector quantization error is limited to an error in low frequency components of the coefficients (e.g. a range from approximately 0 Hz to approximately 2 kHz), and therefore an increase in the number of code bits required for the scalar quantization can be small.

The above and other objects, features, and advantages of the invention will become more apparent from the following detailed description taken in conjunction with the accompanying drawings.

DETAILED DESCRIPTION OF THE PREFERRED EMBODIMENT

The invention will now be described in detail with reference to the drawings showing a preferred embodiment thereof.

Figure 1:
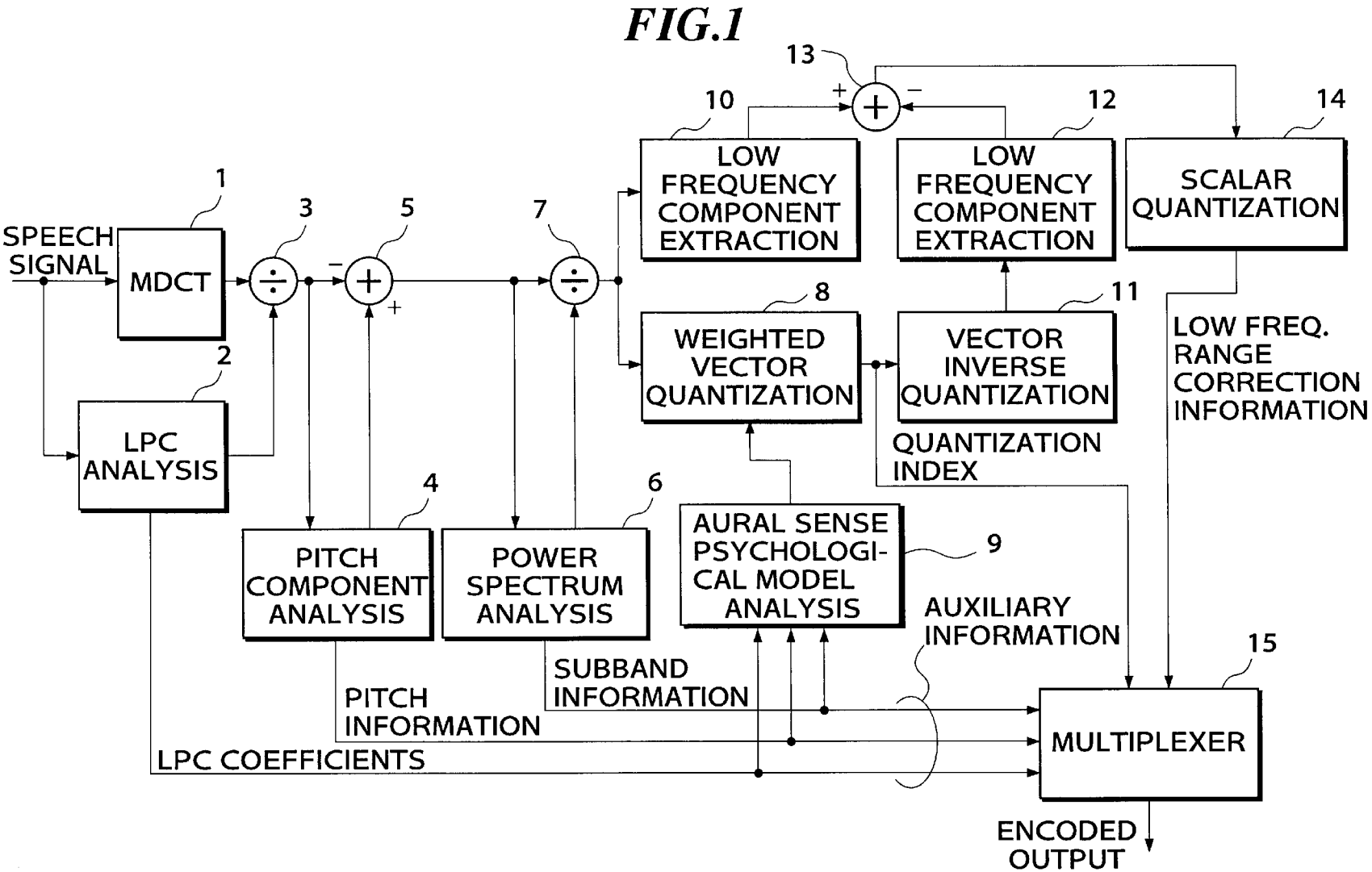
FIG. 1 is a block diagram showing the construction of a speech encoding apparatus forming part of a speech encoding and decoding system according to an embodiment of the invention.

Referring first to FIG. 1, there is illustrated the arrangement of a speech encoding apparatus (transmitting side) of a speech encoding and decoding system according to an embodiment of the invention.

A speech signal which is represented in the time domain, i.e. a digital time series signal is supplied to an MDCT (Modified Discrete Cosine Transform) block 1 as an orthogonal transform device and an LPC (Linear Predictive Coding) analyzer 2 as part of a speech signal analyzing device. The MDCT block 1 divides the speech signal into frames each formed of a predetermined number of samples and orthogonally transforms the samples of each frame according to MDCT into samples in the frequency domain to generate MDCT coefficients. The LPC analyzing block 2 subjects the time series signal corresponding to each frame to LPC analysis using an algorithm such as the covariance method and the autocorrelation method to determine a spectral envelope of the speech signal as prediction coefficients (LPC coefficients), and quantizes the obtained LPC coefficients to generate quantized LPC coefficients.

The MDCT coefficients from the MDCT block 1 are input to a divider 3, where they are divided by the LPC coefficients from the LPC analyzer 2 so that their amplitude values are normalized (smoothed). An output from the divider 3 is delivered to a pitch component analyzer 4, where pitch components are extracted from the output. The extracted pitch components are delivered to a subtracter 5, where they are separated from the normalized MDCT coefficients. The normalized MDCT coefficients with the pitch components thus removed are delivered to a power spectrum analyzer 6, where a power spectrum per sub band is determined. That is, since the amplitude envelope of the MDCT coefficients is actually different from a power spectral envelope obtained by the LPC analysis, a spectral envelope is again obtained from the normalized MDCT coefficients with pitch components removed. The spectral envelope from the power spectrum analyzer 6 is input to a divider 7, where it is normalized. The LPC analyzer 2, pitch component analyzer 4, and power spectrum analyzer 6 constitute the speech signal analyzing device, and the quantized LPC coefficients, pitch information and subband information constitute auxiliary information. The dividers 3, 7 and subtracter 5 constitute a calculating device that smoothes the MDCT coefficients.

The MDCT coefficients thus smoothed using the auxiliary information are subjected to vector quantization by a weighted vector quantizer 8. In carrying out the vector quantization, the vector quantizer 8 compares the MDCT coefficients with each code vector in a code book, and generates as an encoded output a quantization index indicative of a code vector that is found to match most closely the MDCT coefficients. An aural sense psychological model analyzer 9 takes part in the vector quantization by analyzing an aural sense psychological model based on the auxiliary information and weighting the result of vector quantization to apply masking effects thereto such that the quantization error that is sensed by the listener's aural sense is minimized.

In the present embodiment, to compensate for low frequency component distortions caused by the vector quantization error, low frequency range correction information which is obtained by subjecting the vector quantization error to scalar quantization is additionally provided as the encoded output. More specifically, low frequency components are extracted from the smoothed MDCT coefficients by a low frequency component extractor 10. The quantization index from the weighted vector quantizer 8 is vector inversely quantized by a vector inverse quantizer 11, and the resulting decoded smoothed MDCT coefficients are delivered to a low frequency component extractor 12, where low frequency components are extracted from the decoded smoothed MDC coefficients. A subtracter 13 determines a difference between outputs from the low frequency component extractors 10, 12. The vector inverse quantizer 11, lower frequency component extractors 10, 12 and subtracter 13 constitute a low frequency extracting device. The low frequency component extractors 10, 12 are set to extract frequency components within a range from 90 Hz to 1 kHz which is selected as a result of tests conducted by the inventor so as to obtain aurally good results. If the extraction frequency range is expanded, the upper and lower limits of the expanded frequency range may be desirably approximately 0 Hz and approximately 2 kHz, respectively. The quantization error of low frequency components obtained by the subtracter 13 is subjected to scalar quantization by a scalar quantizer 14 to provide the low frequency range correction information.

The quantization index, auxiliary information and low frequency range correction information obtained in the above described manner are delivered to a multiplexer 15 as a synthesis device, where they are synthesized and output as the encoded output.

Figure 2:
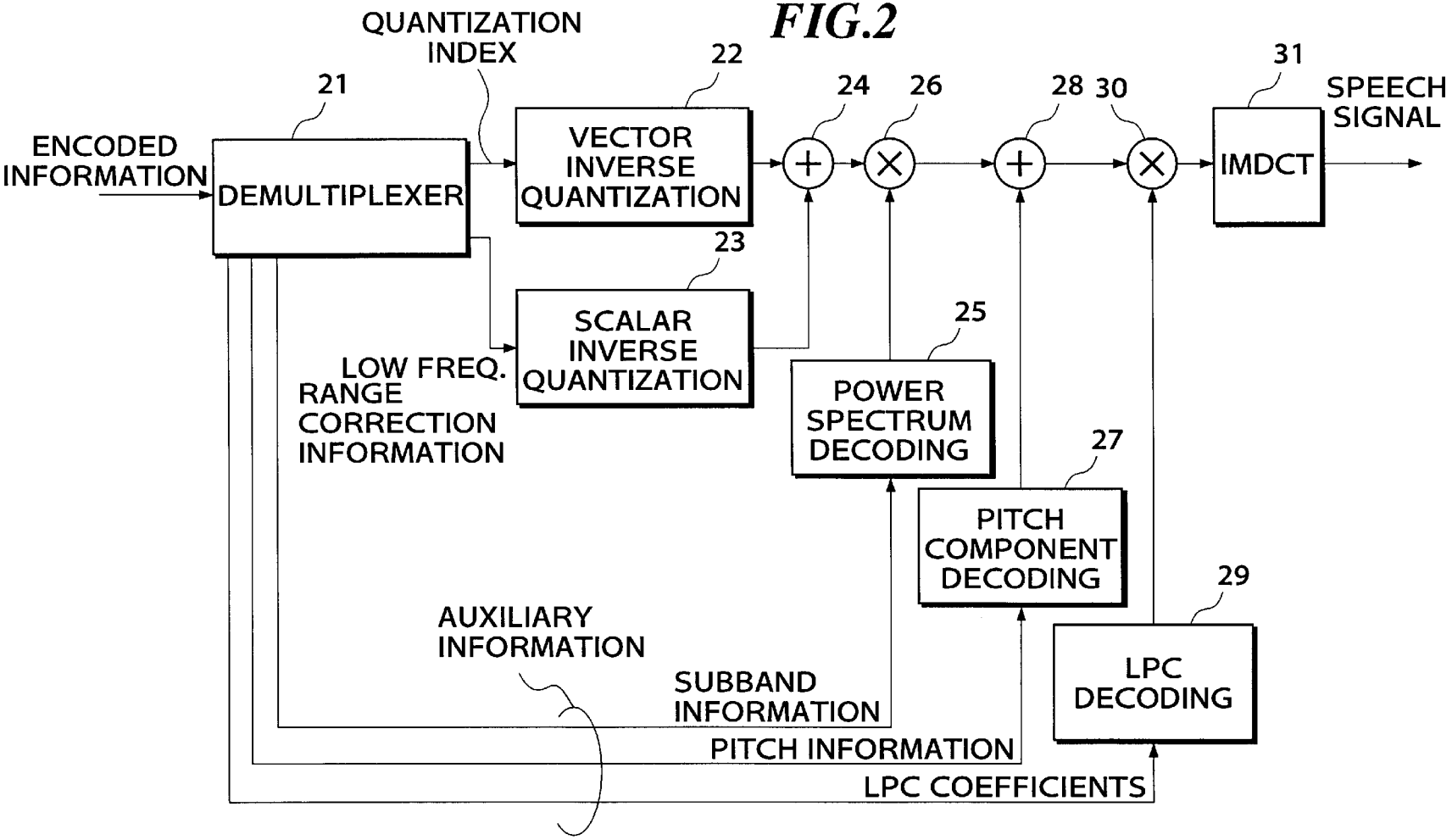
FIG. 2 is a block diagram showing the construction of a speech decoding apparatus forming part of the speech encoding and decoding system.

FIG. 2 shows the construction of a speech decoding apparatus of the speed encoding and decoding system according to the present embodiment.

The speech decoding apparatus of FIG. 2 carries out decoding of the speech signal by processes which are inverse in processing to those described above. More specifically, a demultiplexer 21 as an information separating device, divides the encoded output from the speech encoding apparatus of FIG. 1 into the quantization index, auxiliary information, and low frequency range correction information. A vector inverse quantizer 22 decodes the MDCT coefficients using the same code book as the one used by the vector quantizer 8 of the speech encoding apparatus. A scalar inverse quantizer 23 decodes the low frequency range correction information, to deliver the low frequency component error obtained by the decoding to an adder 24. The adder 24 adds together the low frequency component error and the decoded MDCT coefficients from the vector inverse quantizer 22 to correct low frequency components of the MDCT coefficients. Subband information included in the auxiliary information separated at the demultiplexer 21 is decoded by a power spectrum decoder 25, and the decoded subband information is delivered to a multiplier 26, which multiplies the MDCT coefficients with the low frequency components corrected from the adder 24 by the decoded subband information. Pitch information included in the auxiliary information is decoded by a pitch component decoder 27, and the decoded pitch information is delivered to an adder 28, which adds the pitch information to the spectrum-corrected MDCT coefficients from the multiplier 26. LPC coefficients included in the auxiliary information are decoded by an LPC decoder 29, and the decoded LPC coefficients are delivered to a multiplier 30, which multiplies the pitch-corrected MDCT coefficients from the adder 28 by the LPC coefficients. The MDCT coefficients thus corrected by the above-mentioned components of the auxiliary information are delivered to an IMDCT block 31, where they are subjected to inverse MDCT processing to be converted from the frequency domain into a signal represented in the time domain. Thus, the coded speech signal is decoded into the original speech signal.

According to the present embodiment, as described above, in the speech encoding apparatus, differential low frequency components (vector quantization error) between the smoothed MDCT coefficients before vector quantization and the smoothed MDCT coefficients after the vector quantization are subjected to scalar quantization, and the result of the scalar quantization is delivered as the low frequency range correction information to the speech decoding apparatus, where the MDCT coefficients are vector inversely quantized and then the vector quantization error decoded from the low frequency range correction information is added to the vector inversely quantized MDCT coefficients to thereby decrease the vector quantization error. In the present embodiment, only low frequency components of the vector quantization error are scalar-quantized, which therefore suffices addition of a very small amount of information.

Figure 3:
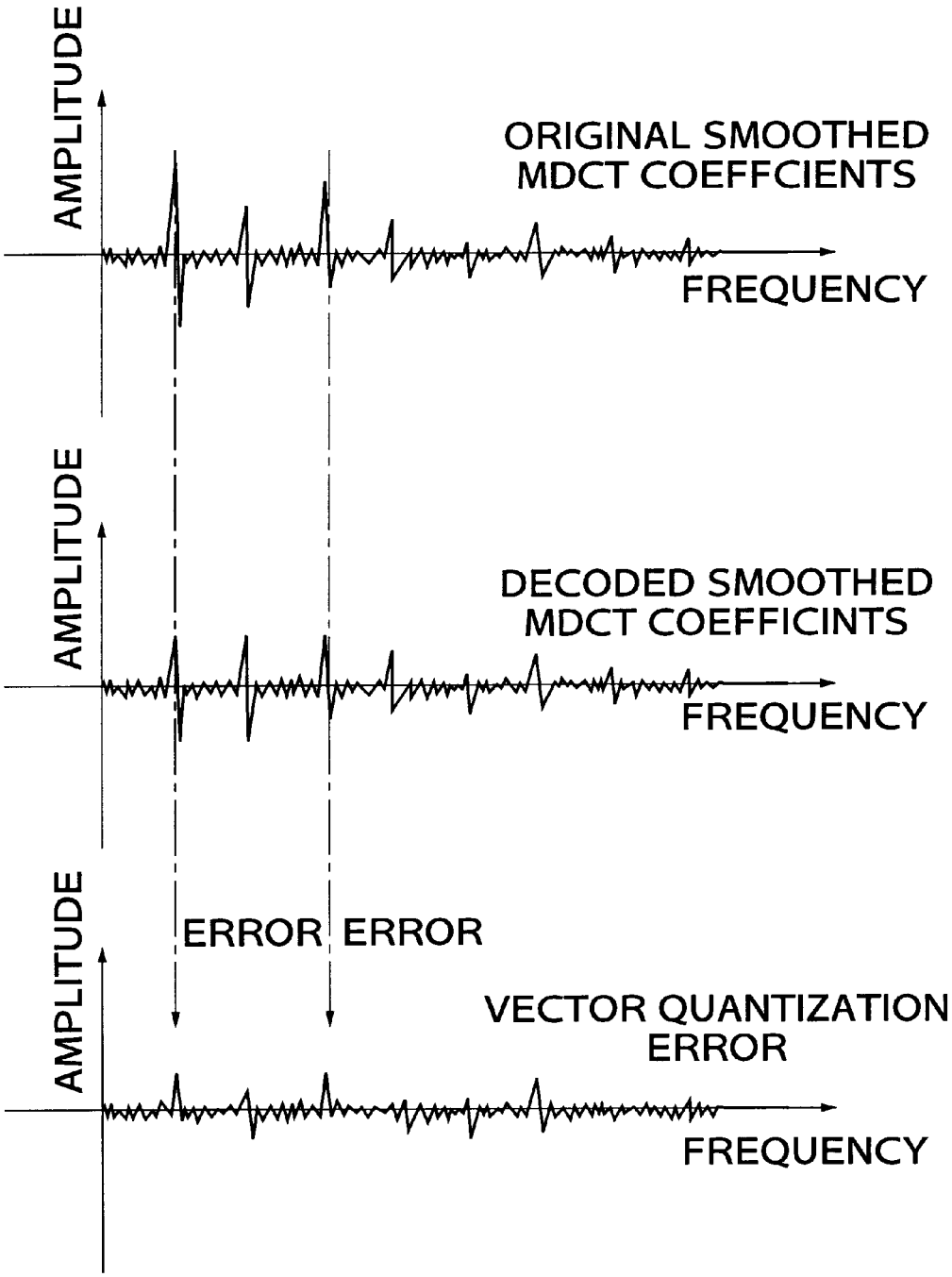
FIG. 3 is a view useful in explaining vector quantization errors obtained by the speech encoding and decoding system.

FIG. 3 shows amplitude vs frequency characteristics of smoothed MDCT coefficients before being subjected to vector quantization, decoded MDCT coefficients after being subjected to vector quantization, and vector quantization error components obtained by the vector quantization. As shown in the figure, large quantization errors appear at frequencies corresponding to the pitch components of the speech signal. To scalar-quantize such vector quantization errors, methods as shown in FIGS. 4 and 5 can be used, for example.

Figure 4:
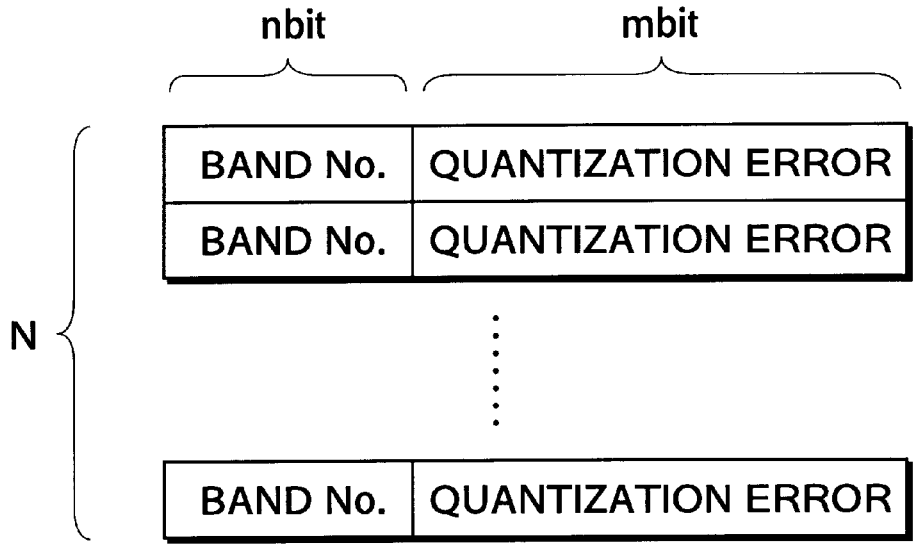
FIG. 4 is a view showing an example of low frequency range correction information used by the speech encoding and decoding system.

FIG. 4 shows an example in which the vector quantization error is evaluated for each frequency band to determine frequency bands (band No.) corresponding to largest quantization errors, and a predetermined number of pairs of such frequency bands corresponding to largest quantization errors and the values of the respective quantization errors are encoded in the order of the magnitude of quantization error. In this example, if a number of bits representing the band No. is designated by n, a number of bits representing the quantization error m, and the predetermined number of pairs to be encoded N, N(n+m) represents a number of bits indicative of the low frequency range correction information.

Figure 5:
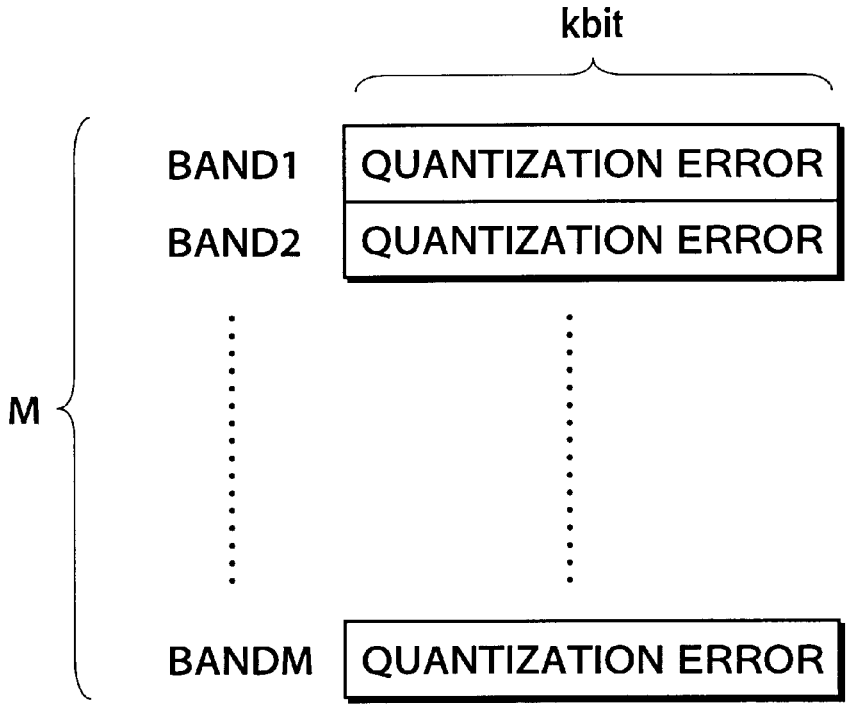
FIG. 5 is a view showing another example of the low frequency range correction information.

FIG. 5 shows an example in which quantization errors at all of predetermined frequency bands are encoded. In this example, the band No. need not be specified. Therefore, if the number of bits representing the quantization error is designated by k, and a number of bits representing the number of frequency bands to be encoded M, Mk represents the number of bits indicative of the low frequency range correction information.

A speech signal includes a signal having a relatively strong or distinct pitch or fundamental tone, and a signal having a random frequency characteristic such as a plosive and a fricative. Therefore, the above-mentioned two quantizing methods may be selectively applied depending upon the nature of vector quantization error determined by the kind of speech signal. More specifically, in the case of a signal having a strong or distinct pitch, large quantization errors appear at frequencies corresponding to the pitch components at certain intervals but the quantization error is very small at other frequencies. Therefore, the number of bits m of the quantization error is set to a relatively large value and the number N of pairs to be encoded to a relatively small value. In the case of a plosive or a fricative, relatively small quantization errors appear over a wide frequency range. Therefore, the number of bits k of the quantization error is set to a relatively small value. The scalar quantizer 14 may evaluate the pattern of the vector quantization error, select one of the above two quantizing methods and add 1-bit mode information indicative of the selected quantizing method to the top of the encoded data.

In this way, with addition of a slight amount of low frequency correction information, the speech encoding and decoding system according to the present embodiment is capable of obtaining a decoded sound of a high quality close to the original sound, by using the conventional code book.

Figure 6:
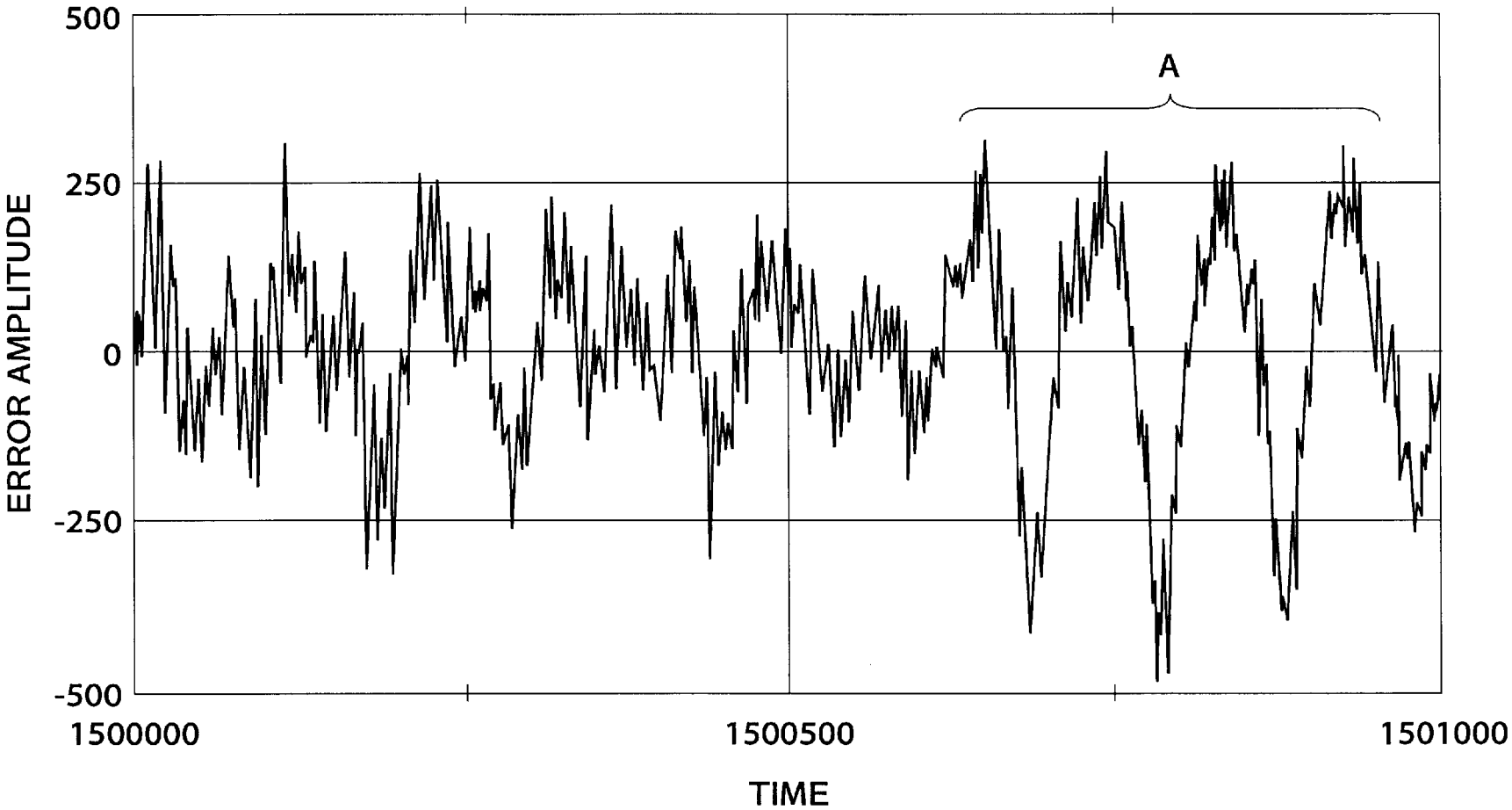
FIG. 6 is a view showing waveforms of a coding error signal obtained by the prior art system.
Figure 7:
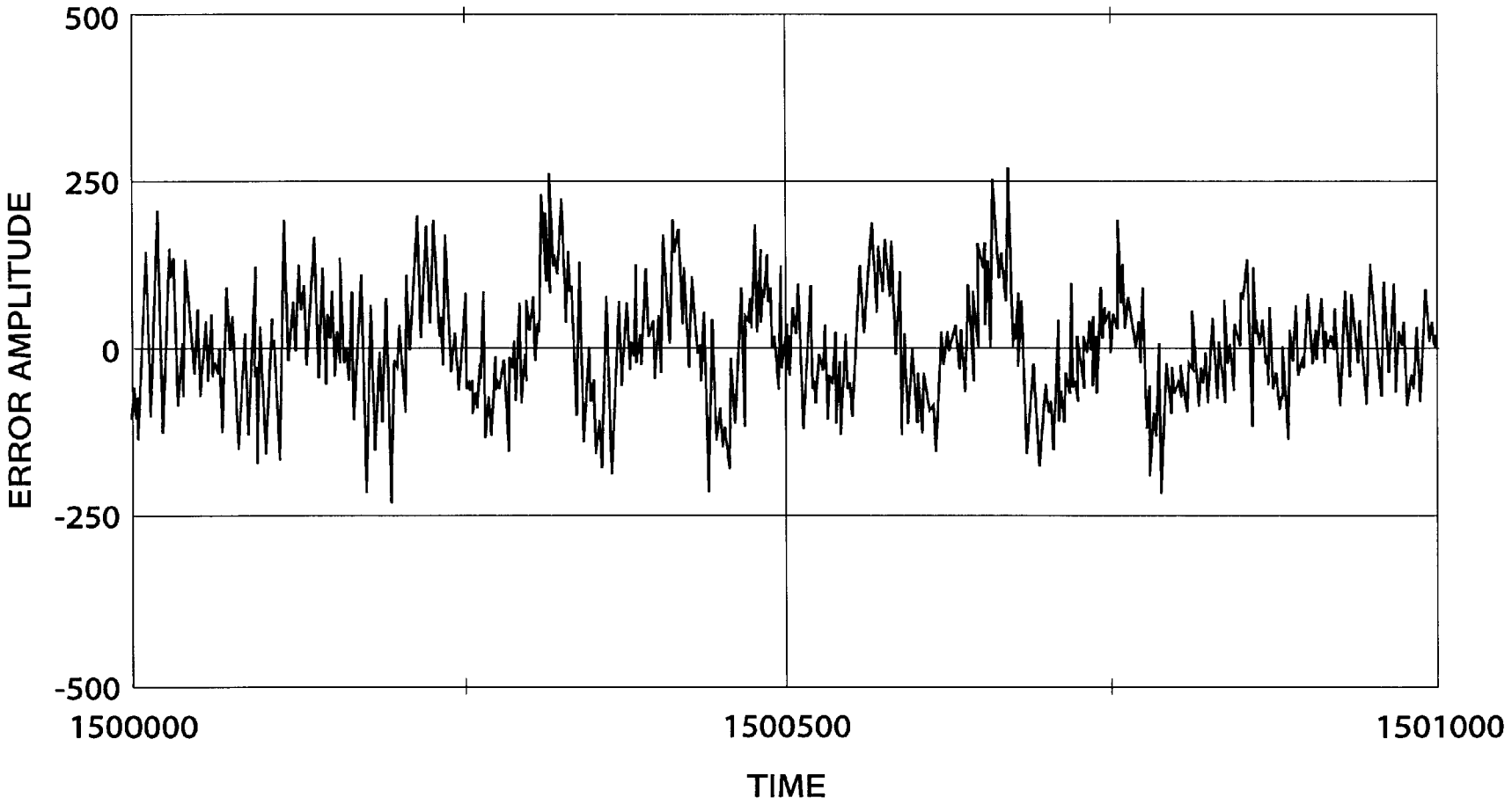
FIG. 7 is a view showing waveforms of a coding error signal obtained by the speech encoding and decoding system according to the present invention.

FIG. 6 shows waveforms of a coding error signal between the original speech signal and its decoded speech signal obtained by the prior art system, with the lapse of time, and FIG. 7 shows waveforms of a coding errors signal between the original speech signal and its decoded speech signal obtained by the present embodiment described above. It can be learned from these figures as well that the system according to the present invention has generally reduced quantization errors. Particularly, as characteristically shown at a portion A in FIG. 6, large quantization errors occur at sound portions which are distinct in pitch in the prior art system, whereas in the system according to the present invention such sound portions have smaller quantization errors conversely to the prior art system. Thus, it is clear from these figures that the present invention is effective to a signal having a strong or distinct pitch in particular.

Figure 8:
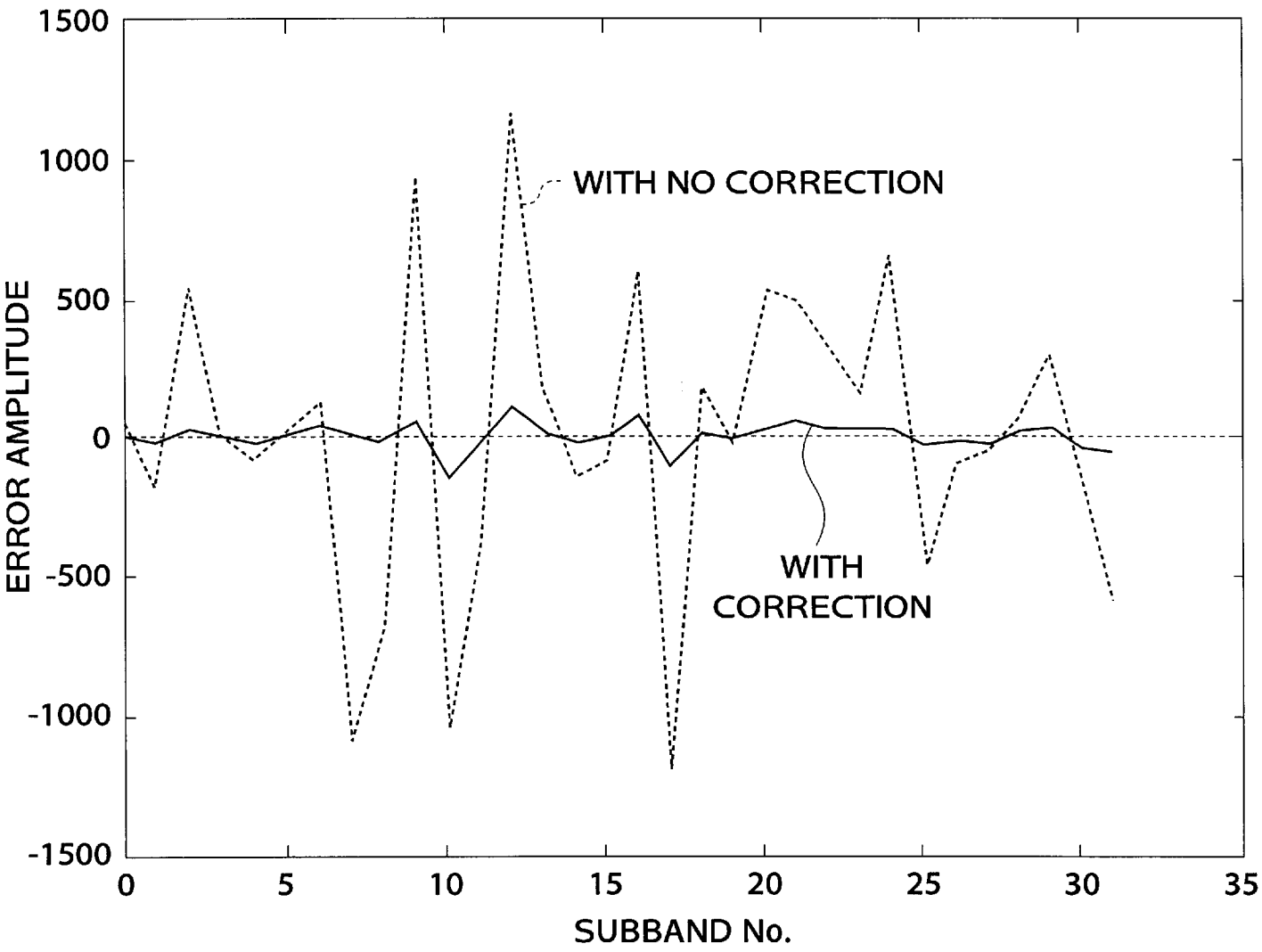
FIG. 8 is a view showing quantization error spectra obtained by the prior art system and the system according to the present invention.

FIG. 8 shows spectrum quantization error spectra obtained by the system according to the present invention in which correction is made of a speech signal using the low frequency range correction information and by the system according to the prior art system in which no such correction is made, respectively. In the figure, the ordinate indicates a scale of amplitude of PCM sample data, i.e. error amplitude, its upper and lower limit values being $\pm 2^{15}$. The abscissa indicates subband numbers (a frequency scale converted from the sampling frequency such that a frequency of fs/2 is equal to a subband No.=512 when the speech signal is subjected to MDCT, a time axis-to-frequency axis conversion, on condition that fs=22.05 kHz and the frame length=512 samples). As is learned from FIG. 8, in the case where no low frequency range correction is made, large quantization errors occur particularly in the low frequency range, whereas when the low frequency range correction is made as in the system according to the present invention, the quantization error is much smaller particularly in the low frequency range.

Although in the above described embodiment the speech encoding apparatus and the speech decoding apparatus according to the invention are constituted by hardware, each of the blocks in FIGS. 1 and 2 can be regarded as a functional block and therefore can be implemented by software. In such a case, a program for carrying out a speech encoding and decoding method which performs substantially the same functions as the speech encoding and decoding system described above may be stored in a suitable storage medium such as FD and CD-ROM, or may be down loaded from an external device via communication media.

What is claimed is:

1. A speech encoding and decoding system comprising:

a speech coding apparatus including an orthogonal transform device that orthogonally transforms an input speech signal represented in a time domain into a signal represented in a frequency domain in units of predetermined blocks into which said speech signal is divided to determine orthogonal transform coefficients, a speech signal analyzing device that analyzes said speech signal to determine auxiliary information for smoothing said orthogonal transform coefficients, a first calculating device that smoothes said orthogonal transform coefficients by means of said auxiliary information determined by said speech signal analyzing device, a vector quantization device that vector-quantizes said orthogonal transform coefficients smoothed by said first calculating device to generate a quantization index indicative of said smoothed orthogonal transform coefficients vector-quantized by said vector quantization device, a low frequency component error-extracting device that extracts a vector quantization error of low frequency components of said smoothed orthogonal transform coefficients vector-quantized by said vector quantization device, a low frequency range correction information-determining device that scalar-quantizes said vector quantization error extracted by said low frequency component error-extracting device to determine low frequency range correction information, and a synthesis device that synthesizes said auxiliary information from said speech signal analyzing device, said quantization index from said vector quantization device, and said low frequency range correction information from said low frequency range correction information-determining device to output them as an encoded output; and a speech decoding apparatus including a vector inverse quantization device that vector inversely quantizes said quantization index included in said encoded output from said speech encoding apparatus to decode said orthogonal transform coefficients, an auxiliary information decoding device that decodes said auxiliary information included in said encoded output from said speech encoding apparatus, a low frequency range correction information-decoding device that decodes said low frequency range correction information included in said encoded output from said speech encoding apparatus, a second calculating device that corrects said low frequency components of said orthogonal transform coefficients decoded by said vector inverse quantization device by means of said low frequency range correction information decoded by said low frequency range correction information-decoding device, and restores the corrected orthogonal transform coefficients into a state before being smoothed by means of said auxiliary information decoded by said auxiliary information decoding device, and an orthogonal inverse transform device that orthogonally inversely transforms said orthogonal transform coefficients restored into said state before being smoothed by said second calculating device into a signal represented in the time domain to thereby decode said speech signal represented in the time domain.

2. A speech encoding and decoding system as claimed in claim 1, wherein said speech encoding apparatus includes a second vector inverse quantization device that vector inversely quantizes said quantization index from said vector quantization device to generate decoded orthogonal transform coefficients, said low frequency component error-extracting device extracting an error between said low frequency components of said smoothed orthogonal transform coefficients from said first calculating device and low frequency components of said decoded orthogonal transform coefficients from said second vector inverse quantization device.

3. A speech encoding apparatus comprising:

an orthogonal transform device that orthogonally transforms an input speech signal represented in a time domain into a signal represented in a frequency domain in units of predetermined blocks into which said speech signal is divided to determine orthogonal transform coefficients;

a speech signal analyzing device that analyzes said speech signal to determine auxiliary information for smoothing said orthogonal transform coefficients;

a calculating device that smoothes said orthogonal transform coefficients by means of said auxiliary information determined by said speech signal analyzing device;

a vector quantization device that vector-quantizes said orthogonal transform coefficients smoothed by said calculating device to generate a quantization index indicative of said smoothed orthogonal transform coefficients vector-quantized by said vector quantization device;

a low frequency component error-extracting device that extracts a vector quantization error of low frequency components of said smoothed orthogonal transform coefficients vector-quantized by said vector quantization device;

a low frequency range correction information-determining device that scalar-quantizes said vector quantization error extracted by said low frequency component error-extracting device to determine low frequency range correction information; and a synthesis device that synthesizes said auxiliary information from said speech signal analyzing device, said quantization index from said vector quantization device, and said low frequency range correction information from said low frequency range correction information-determining device to output them as an encoded output.

4. A speech encoding apparatus as claimed in claim 3, including a second vector inverse quantization device that vector inversely quantizes said quantization index from said vector quantization device to generate decoded orthogonal transform coefficients, said low frequency component error-extracting device extracting an error between said low frequency components of said smoothed orthogonal transform coefficients from said calculating device and low frequency components of said decoded orthogonal transform coefficients from said second vector inverse quantization device.

5. A speech decoding apparatus comprising:

an information separating device that receives and separates auxiliary information for smoothing orthogonal transform coefficients obtained by orthogonally transforming an input speech signal represented in a time domain into a signal represented in a frequency domain in units of predetermined blocks into which said speech signal is divided, a quantization index obtained by vector-quantizing said orthogonal transform coefficients smoothed by means of said auxiliary information, and low frequency range correction information obtained by scalar-quantizing a vector quantization error of low frequency components of said smoothed orthogonal transform coefficients;

a vector inverse quantization device that vector inversely quantizes said quantization index separated by said information separating device to decode said orthogonal transform coefficients;

an auxiliary information decoding device that decodes said auxiliary information separated by said information separating device;

a low frequency range correction information-decoding device that decodes by inverse scalar quantization said low frequency range correction information separated by said information separating device;

a calculating device that corrects said low frequency components of said orthogonal transform coefficients decoded by said vector inverse quantization device by means of said low frequency range correction information decoded by said low frequency range correction information-decoding device, and restores the corrected orthogonal transform coefficients into a state before being smoothed by means of said auxiliary information decoded by said auxiliary information decoding device;

and an orthogonal inverse transform device that orthogonally inversely transforms said orthogonal transform coefficients restored into said state before being smoothed by said calculating device into a signal represented in the time domain to thereby decode said speech signal represented in the time domain.

6. A speech encoding and decoding method comprising:

a speech coding process including an orthogonal transform step of orthogonally transforming an input speech signal represented in a time domain into a signal represented in a frequency domain in units of predetermined blocks into which said speech signal is divided to determine orthogonal transform coefficients, a speech signal analyzing step of analyzing said speech signal to determine auxiliary information for smoothing said orthogonal transform coefficients, a first calculating step of smoothing said orthogonal transform coefficients by means of said auxiliary information determined by said speech signal analyzing step, a vector quantization step of vector-quantizing said orthogonal transform coefficients smoothed by said first calculating step to generate a quantization index indicative of said smoothed orthogonal transform coefficients vector-quantized by said vector quantization step, a low frequency component error-extracting step of extracting a vector quantization error of low frequency components of said smoothed orthogonal transform coefficients vector-quantized by said vector quantization step, a low frequency range correction information-determining step of scalar-quantizing said vector quantization error extracted by said low frequency component error-extracting step to determine low frequency range correction information, and a synthesis step of synthesizing said auxiliary information obtained by said speech signal analyzing step, said quantization index obtained by said vector quantization step, and said low frequency range correction information obtained by said low frequency range correction information-determining step to output them as an encoded output; and a speech decoding process including a vector inverse quantization step of inversely vector-quantizing said quantization index included in said encoded output provided by said speech encoding process to decode said orthogonal transform coefficients, an auxiliary information decoding step of decoding said auxiliary information included in said encoded output, a low frequency range correction information-decoding step of decoding said low frequency range correction information included in said encoded output, a second calculating step of correcting said low frequency components of said orthogonal transform coefficients decoded by said vector inverse quantization step by means of said low frequency range correction information decoded by said low frequency range correction information-decoding step, and restores the corrected orthogonal transform coefficients into a state before being smoothed by means of said auxiliary information decoded by said auxiliary information decoding step, and an orthogonal inverse transform step of orthogonally inversely transforming said orthogonal transform coefficients restored into said state before being smoothed by said second calculating step into a signal represented in the time domain to thereby decode said speech signal represented in the time domain.

7. A storage medium storing a program for carrying out a speech encoding and decoding method, the method comprising:

a speech coding process including an orthogonal transform step of orthogonally transforming an input speech signal represented in a time domain into a signal represented in a frequency domain in units of predetermined blocks into which said speech signal is divided to determine orthogonal transform coefficients, a speech signal analyzing step of analyzing said speech signal to determine auxiliary information for smoothing said orthogonal transform coefficients, a first calculating step of smoothing said orthogonal transform coefficients by means of said auxiliary information determined by said speech signal analyzing step, a vector quantization step of vector-quantizing said orthogonal transform coefficients smoothed by said first calculating step to generate a quantization index indicative of said smoothed orthogonal transform coefficients vector-quantized by said vector quantization step, a low frequency component error-extracting step of extracting a vector quantization error of low frequency components of said smoothed orthogonal transform coefficients vector-quantized by said vector quantization step, a low frequency range correction information-determining step of scalar-quantizing said vector quantization error extracted by said low frequency component error-extracting step to determine low frequency range correction information, and a synthesis step of synthesizing said auxiliary information obtained by said speech signal analyzing step, said quantization index obtained by said vector quantization step, and said low frequency range correction information obtained by said low frequency range correction information-determining step to output them as an encoded output; and a speech decoding process including an vector inverse quantization step of inversely vector-quantizing said quantization index included in said encoded output provided by said speech encoding process to decode said orthogonal transform coefficients, an auxiliary information decoding step of decoding said auxiliary information included in said encoded output, a low frequency range correction information-decoding step of decoding said low frequency range correction information included in said encoded output, a second calculating step of correcting said low frequency components of said orthogonal transform coefficients decoded by said vector inverse quantization step by means of said low frequency range correction information decoded by said low frequency range correction information-decoding step, and restores the corrected orthogonal transform coefficients into a state before being smoothed by means of said auxiliary information decoded by said auxiliary information decoding step, and an orthogonal inverse transform step of orthogonally inversely transforming said orthogonal transform coefficients restored into said state before being smoothed by said second calculating step into a signal represented in the time domain to thereby decode said speech signal represented in the time domain.

* * * * *